US005820888A

United States Patent [19]

Geus et al.

[11] Patent Number: 5,820,888

[45] Date of Patent: Oct. 13, 1998

[54] APPARATUS FOR PRODUCING A SPUN-BOND WEB FROM SYNTHETIC RESIN FILAMENTS

[75] Inventors: Hans Georg Geus; Detlef Frey, both of Niederkassel; Sebastian Sommer, Troisdorf, all of Germany

[73] Assignee: Reifenhauser GmbH & Co. Maschinenfabrik, Troisdorf, Germany

[21] Appl. No.: 823,638

[22] Filed: Mar. 25, 1997

[30] Foreign Application Priority Data

Mar. 27, 1996 [DE] Germany ..... 196 12 142.6

[51] Int. Cl.[6] ..... B29C 55/000

[52] U.S. Cl. ..... 425/66; 425/72.2; 425/81.1; 264/176.1; 264/210.8

[58] Field of Search ..... 425/72.2, 7, 81.1, 425/66; 264/12, DIG. 75, 176.1, 210.8

[56] References Cited

U.S. PATENT DOCUMENTS

| | | | |
|---|---|---|---|
| 2,033,488 | 3/1936 | Sherman | 425/81.1 |
| 2,336,745 | 12/1943 | Manning | 425/81.1 |
| 2,455,174 | 11/1948 | Hitt | 264/DIG. 75 |
| 2,698,271 | 12/1954 | Clark | 425/81.1 |
| 2,732,885 | 1/1956 | Van Der Hoven | 425/81.1 |
| 3,963,392 | 6/1976 | Goyal | 425/81.1 |
| 4,420,441 | 12/1983 | Singer | 264/12 |
| 4,627,811 | 12/1986 | Greiser et al. | 425/72.2 |
| 4,761,258 | 8/1988 | Enloe | 425/80.1 |

FOREIGN PATENT DOCUMENTS

| | | | |
|---|---|---|---|
| 4014989 | 11/1991 | Germany | 425/72.2 |
| 42 36 514 | 4/1994 | Germany . | |
| 42 36 514 A1 | 4/1994 | Germany . | |
| 43 12 419 | 10/1994 | Germany . | |
| 43 12 419 C2 | 2/1996 | Germany . | |

*Primary Examiner*—Jay H. Woo
*Assistant Examiner*—Robert Hopkins
*Attorney, Agent, or Firm*—Herbert Dubno

[57] ABSTRACT

A spun-bond apparatus has at the lower edge of the diffuser below the filaments stretching shaft, cooler and spinneret, partitions which run from the lower edge of the diffuser to upper rollers and pressing roller pairs upstream and downstream of the diffuser along the perforated collecting belt on which the spun-bond web is formed. These partitions parallel to the belt and spaced 15 to 50 mm from the collecting surface have been found to limit turbulence which tends to affect the structure of the web in earlier spun-bond fabricating apparatus.

12 Claims, 4 Drawing Sheets

APPARATUS FOR PRODUCING A SPUN-BOND WEB FROM SYNTHETIC RESIN FILAMENTS

FIELD OF THE INVENTION

Our present invention relates to an apparatus for producing spun bond from synthetic-resin filaments, and more particularly, to an apparatus in which the filaments are produced, commingled in a descending curtain thereof to form a web, and wherein the web is pressed between two rollers after collecting on an endless surface.

BACKGROUND OF THE INVENTION

In the production of spun bond, synthetic-resin filaments are extruded in a descending curtain from a spinneret disposed above a cooling zone in which the descending curtain of synthetic-resin filaments is subjected to contact with cooling air and thus the thermoplastic of the filaments is cooled and the filaments thereby rendered coherent.

Below the cooling portion of the path of these filaments is a stretching shaft in which, by entrainment of the filaments with process air, the filaments are stretched to increase their strength and induce molecular orientation. Below the cooling shaft, in turn, is a diffuser which is defined between divergent walls and in which a commingling of the filaments of the curtain can take place as the filaments deposit, below the lower end of the diffuser, upon a perforated or sieve belt. The latter belt, generally an endless belt defining an endless receiving surface, carries the web of entangled filaments between a front roller pair which compacts the deposited web and can serve to bond filaments together where they cross over or lie against one another. The result is a spun-bond web.

The region of the perforated belt below the diffuser lies above a suction shaft which draws the process air through this portion of the belt and induces the commingling filaments to deposit upon the receiving surface. It also serves to induce the flow of process air from the diffuser through the belt and into the suction shaft.

An apparatus of this type operates continuously to produce the spun-bond web and the spun-bond web has a certain width which corresponds to the width of the diffuser, the rollers and the belt.

In an apparatus of this type, between the diffuser and the upper roller of the compaction roller pair downstream of the diffuser in the direction of travel of the web, a chamber is provided which can be formed with a wall to prevent uncontrolled escape of process air from the diffuser, there being, of course, means along the longitudinal edges of the web which is formed to prevent escape of process air in these regions as well. The provision of a chamber as described has been found to avoid uncontrolled air currents which can affect the quality of the product.

It has been the practice to form this chamber with a wall which extends from a part of the diffuser wall above its lower edge, i.e. from a location above the diffuser outlet, upwardly at an angle of 40° to 45°, to a location close to the upper roller.

This arrangement has resulted in the formation of a large-volume chamber which communicates through the web-passing gap between the lower end of the diffuser and the receiving surface of the perforated belt in accordance with aerodynamic laws. With high outputs of the apparatus and thus high energies of the process air flow, the flow of air into this chamber can be comparatively high. Since the configuration of the chamber in the past has been determined largely by machine design conveniences and the flow of air into that chamber has fluctuated depending upon the output of the apparatus and its operating conditions, and the interaction of the air with the web in the chamber and as the web enters the chamber could not be controlled, defects could occur in the web. Such defects were especially pronounced with higher process air flows and higher machine outputs. When two or more spun-bond web-producing units were provided in succession to produce respective layers which were then combined to form the spun-bond web, the occurrence of such defects became especially pronounced.

In the following description, we may refer to pressing roller pairs ahead of and behind the diffuser to mean the pressing roller pair which is downstream of the diffuser in the direction of travel of the receiving surface or belt and another roller pair which is provided upstream of the diffuser. We also may refer to the spun-bond web which is produced as a fleece, with the understanding that the web which is produced consists of commingled and intertwisted or entangled filaments, loops of which may extend randomly and which, therefore, may have texture, porosity and like characteristics of a fleece.

It is known, for example, from DE 42 36 514 A1 to provide a diffuser so that it itself is a chamber terminating in a pressing roller. It is also known from DE 43 12 419 to extend the diffuser walls substantially to the upper rollers of a pair of pressing rollers closing each side of the region in which the filaments are deposited on the receiving surface. However, neither of these systems completely solves the problem of avoiding defects at high-process air flow rates where the bottom of the diffuser is spaced from at least the upper roller of the pair of pressing rollers downstream of the diffuser in the direction of displacement of the receiving surface.

OBJECTS OF THE INVENTION

It is the principal object of the present invention to provide an apparatus for producing a spun-bond web or fleece and wherein the diffuser outlet is spaced from an upper roller of a downstream pair of pressing rollers and a chamber is formed between the bottom of the diffuser and that upper roller, whereby drawbacks of earlier constructions of that type are obviated.

Another object of the invention is to provide an improved apparatus for producing a spun-bond web whereby the structural defects in the resulting web no longer can arise.

Still another object of this invention is to provide an improved apparatus for the production of high quality, uniform spun bond, free from the problems enumerated above.

SUMMARY OF THE INVENTION

These objects and others which will become apparent hereinafter are attained, in accordance with the invention, by providing between the diffuser outlet and the upper roller of the upstream roller pair, a partition wall which lies substantially parallel to the receiving surface and defines a gap therewith which remains of substantially constant width between the diffuser outlet and the upper roller. Advantageously, a similar partition extends to the upper roller of the downstream roller pair. The partitions can be formed as closed walls of sheet metal or plastic and can be provided, at their ends proximal to the respective upper rollers, with sealing formations or devices.

The invention is based upon a number of experiments which have demonstrated that defects in the spun-bond structure in many cases are a result of the aforedescribed aerodynamic communication between the chambers at the diffuser outlet and the upper rollers of the two pairs of rollers flanking the diffuser outlet. Apparently in the earlier chamber configurations and constructions, the aerodynamic flows of process air could give rise to highly energetic turbulence which could cause structural defects in the spun-bond web which is produced, probably because the turbulent energy produces transverse flows which alter the loop formation or the manner in which the loops deposit upon the receiving surfaces.

These problems are avoided according to the invention partly by the significant reduction in the volume of the chamber via the partition and by providing the partition so that it is parallel to the receiving surface and thus defines a uniform gap therewith which appears to suppress these transverse currents. This applies not only in the chamber running to the upper roller of the upstream roller pair but to the upper roller of the downstream roller pair as well. By suppressing the turbulence introduced by the aerodynamic communication and the aerodynamic communication itself between the diffuser outlet and the chambers, the defects in the spun-bond web formation are reduced or eliminated.

In practice, it has been found to be desirable to reduce the gap between the partition and the receiving surface to a minimum, although an optimum gap width will have to be selected empirically for each apparatus and the particular output and operating parameters thereof.

Where the diffuser angle is adjustable, a movable wall of the diffuser can serve for the adjustment and then the partition bridging between this wall and the respective upper roller can comprise two wall portions, one of which sealingly engages the upper roller while the other is connected to the movable diffuser wall. The two portions of the partition can overlap midway between them. This allows adjustment of the diffuser angle while maintaining the partition in place.

The edge of the diffuser at which the partition is connected thereto can project toward the receiving surface in the form of a baffle for the flow of air into the chamber and out of the chamber. This baffle effect can be achieved when the edge of the diffuser outlet is a sharp sheet metal edge and the fleece-forming distance is small. However, the diffuser outlet can also be a portion projecting angularly at the diffuser edge in the form of a small flange and as free as possible from rounding.

The detrimental communication with the chamber can be further reduced by providing the partition as a perforated plate and enabling air to be fed into the system through the perforated plate. A corresponding connection to a suction source can be provided and a special advantage is a configuration in which process air is sucked through the perforated plate from the chamber. In all of these cases there is a reduction in the turbulence in the chamber by removing air and thus energy therefrom.

In accordance with the invention, in the suction shaft means can be provided for withdrawing air from the system and the suction shaft can have in the region of the lower roller or the regions of the lower rollers of the pressing roller pairs, transverse to the direction of movement of the receiving surface, on at least one side, a perforated wall through which air entering the suction shaft can be drawn off. Where suction is applied or air flow is induced, means can be provided to control or regulate the air flow through the perforated member.

The apparatus of the invention allows especially high outputs of the spun-bond web without the drawbacks which have been achieved with earlier systems and especially with the advantage that a plurality of units can be ganged to produce multilayer webs without multiplication of defects and detrimental effects of one unit upon another.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 4:
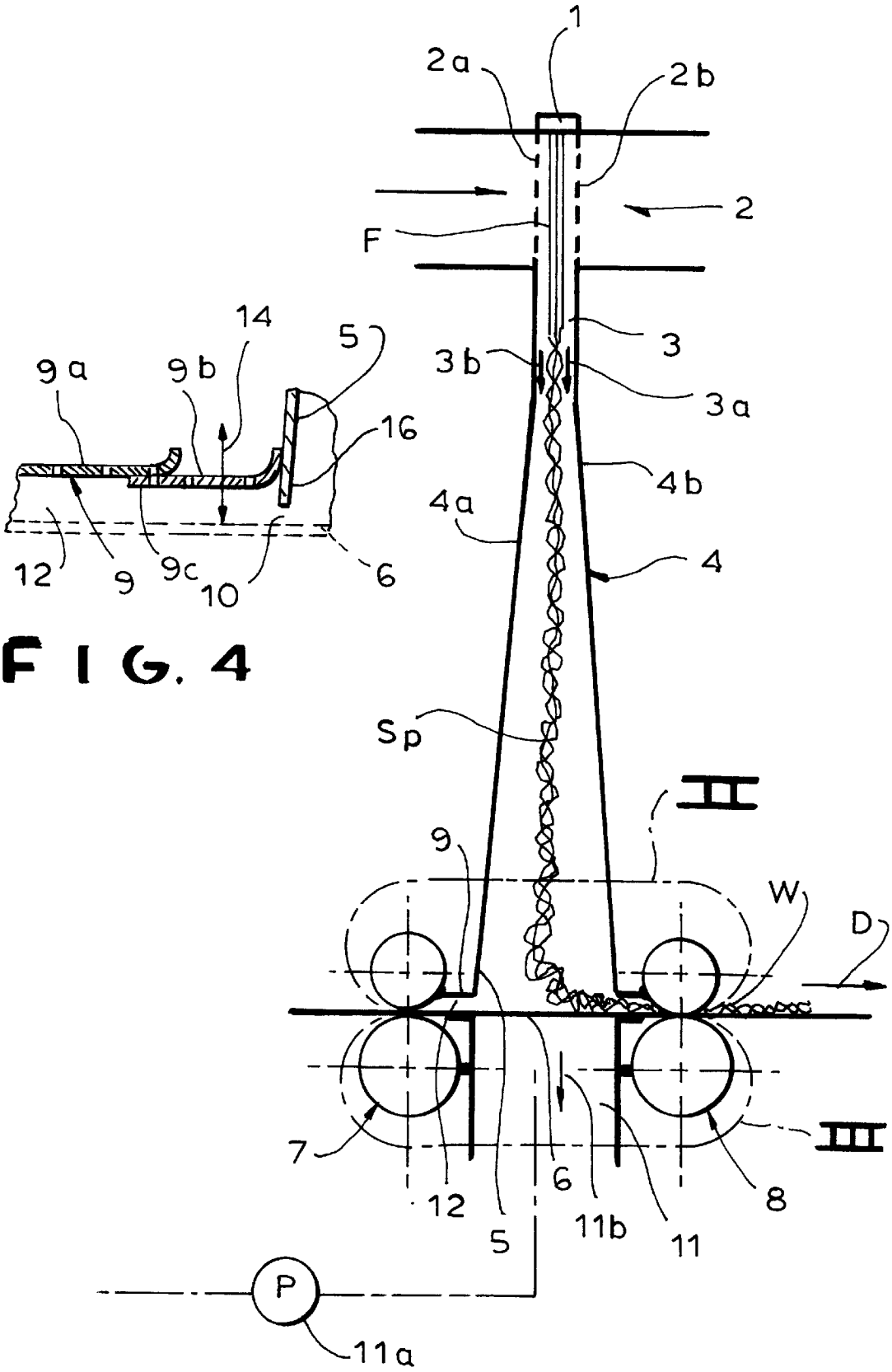
FIG. 1 is a side view in highly diagrammatic form of an apparatus in accordance with the invention.
FIG. 4 is a detail of the partition construction with its overlapping parts.

The apparatus shown in the drawing is used for the production of spun-bond webs or fleeces from thermoplastic synthetic-resin filaments and, since many of the elements of the apparatus are standard in the art, this description will concentrate on the features of the apparatus which are unique to the present invention.

Basically a spun-bond apparatus comprises a spinneret 1 form which a curtain of thermoplastic filaments F are extruded downwardly through a cooling unit 2 in which the filaments are brought into direct contact with cooling air which can be passed into contact with the filaments through perforated walls 2*a*, 2*b*. The curtain of filaments then passes through a stretching shaft 3 in which the filaments are entrained by a downward flow of process air represented by the arrows 3*a* and are thereby stretched to strengthen these filaments.

Below the stretching shaft 3 is a diffuser 4 formed by two downwardly diverging walls 4*a*, 4*b*, the end wall being unillustrated and, of course, delimiting the diffuser and opposite ends thereof spaced apart across the width of the web to be produced.

At the bottom end, the diffuser has an outlet 5 which is located above a perforated receiving surface 6 in the form of an endless sieve belt of which only the upper stretch has been shown. The rollers over which this belt passes and by means of which a lower stretch of the belt is returned to an upstream side thereof have not been shown.

The upper stretch of the belt also passes through two pressing roller pairs 7 and 8 which are located in the direction of displacement of the belt, upstream of and downstream of the diffuser 4. The diffuser outlet 5 is, therefore, the lower edge of the diffuser and is coextensive in area with a suction shaft 11 below the perforated receiving surface 6 which can be connected to a suction source 11*a* to draw air through the belt 6 as represented by the arrow 11*b*. The suction unit, therefore, draws process air from the diffuser through the spun fleece $S_p$ deposited upon the belt 6, and pressed by the rollers 8 to form the web W.

Between the upper rollers of the upstream roller pair 7 and the downstream roller pair 8 and the walls 4*a* and 4*b* of the diffuser 4, are partitions 9 which define chambers 12 communicating with the diffuser 4 at the outlet 5 and extending to the respective upper rollers. As can be seen from FIGS. 2 and 4, the partitions 9 are connected to the diffuser 4 at the outlet 5, extend parallel to the belt or receiving surface 6 and define the gap which constitutes the respective chamber 12. At the upper roller 7*a* or 8*a* of the respective pair, the partition 9 is provided with a seal 13 which rides on the respective roller.

The partitions 9 are comprised of sheet metal or plastic and are preferably spaced at 15 to 50 mm from the belt 6 and preferably at 20 mm from the belt 6. The double-headed arrow 14 indicates that the partition 9 can be adjusted in its distance from the belt 6 and thus indicates that the gap or height of the chamber 12 can be adjusted (see FIG. 4).

In the drawing it has been shown that the diffuser 4 can have an adjustable diffuser angle 15 by swinging movement of the respective diffuser wall. To facilitate such adjustment, the partition 9 can be composed of two parts 9*a* and 9*b*, overlapping at 9*c* and respectively supported against the upper roller 7*a* or 7*b* and connected to the respective diffuser wall 4*a* or 4*b*.

The edge of the diffuser outlet 5 can project downwardly at 16 and can be a sharp edge which forms a baffle restricting the clearance 10 through which air can pass from the diffuser into the chamber 12. Other baffle configurations can be used as well.

Figure 2:
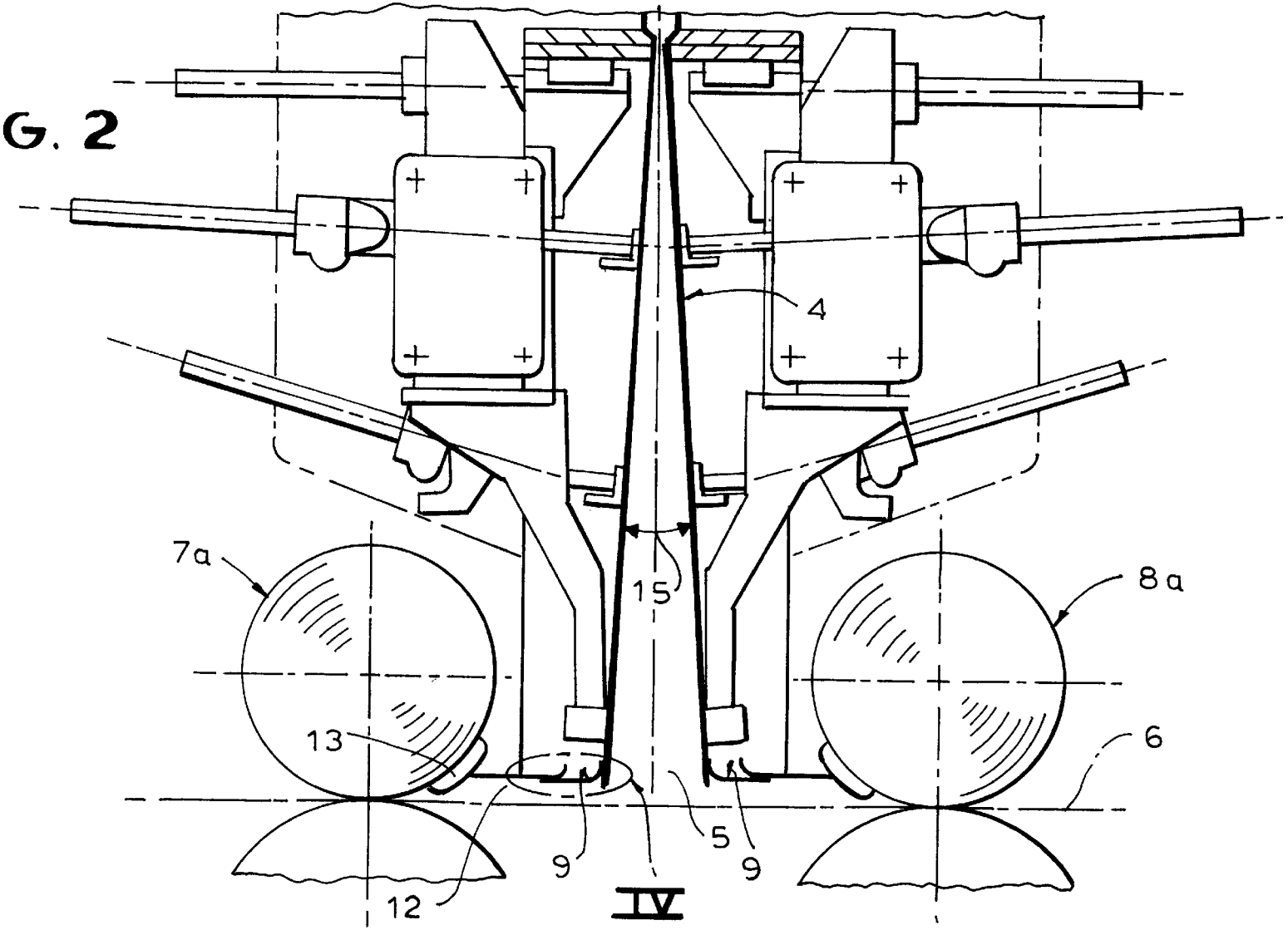
FIG. 2 is a detail of the regions II of FIG. 1 showing additional elements.

FIG. 4 shows further that the partition 9 can be a perforated member so that air can be sucked into the chamber 12. It is also possible, where the partition is perforated, to suck air out of the chamber 12 through this partition.

Figure 3:
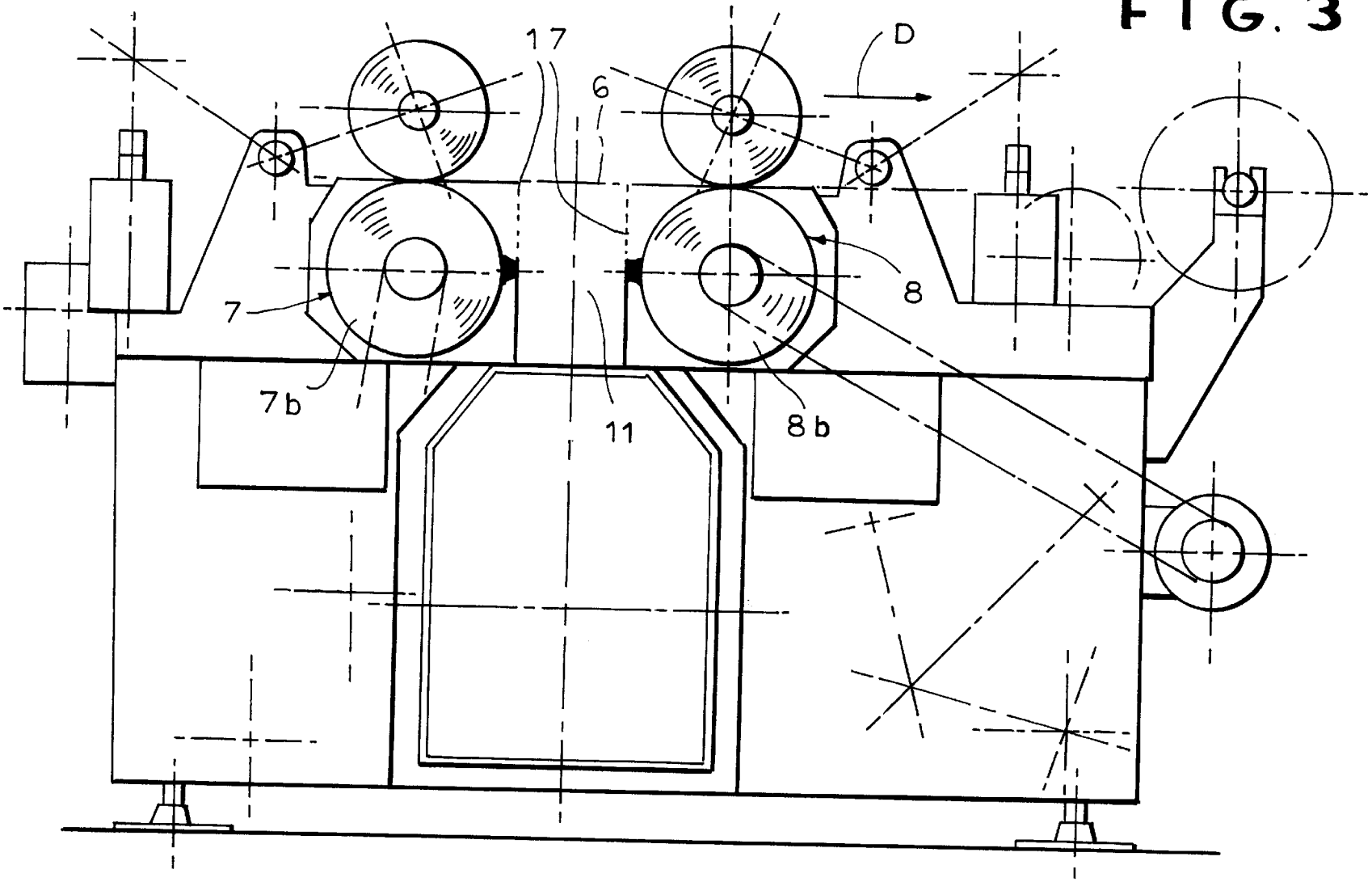
FIG. 3 is a detail of the region III of FIG. 1, also showing additional elements.

As can be seen from FIG. 3, the suction shaft 11 may be flanked by perforated walls 17 in the region of the driven lower rollers 7*b* and 8*b*, the perforated walls 17 running perpendicular to the travel direction D of the web. Air which enters the shaft 11 can be drawn out through these perforated walls if desired. The amounts of air which are displaced can be controlled or regulated, e.g. by adjustment of the suction source 11*a*, for instance.

Figure 5:
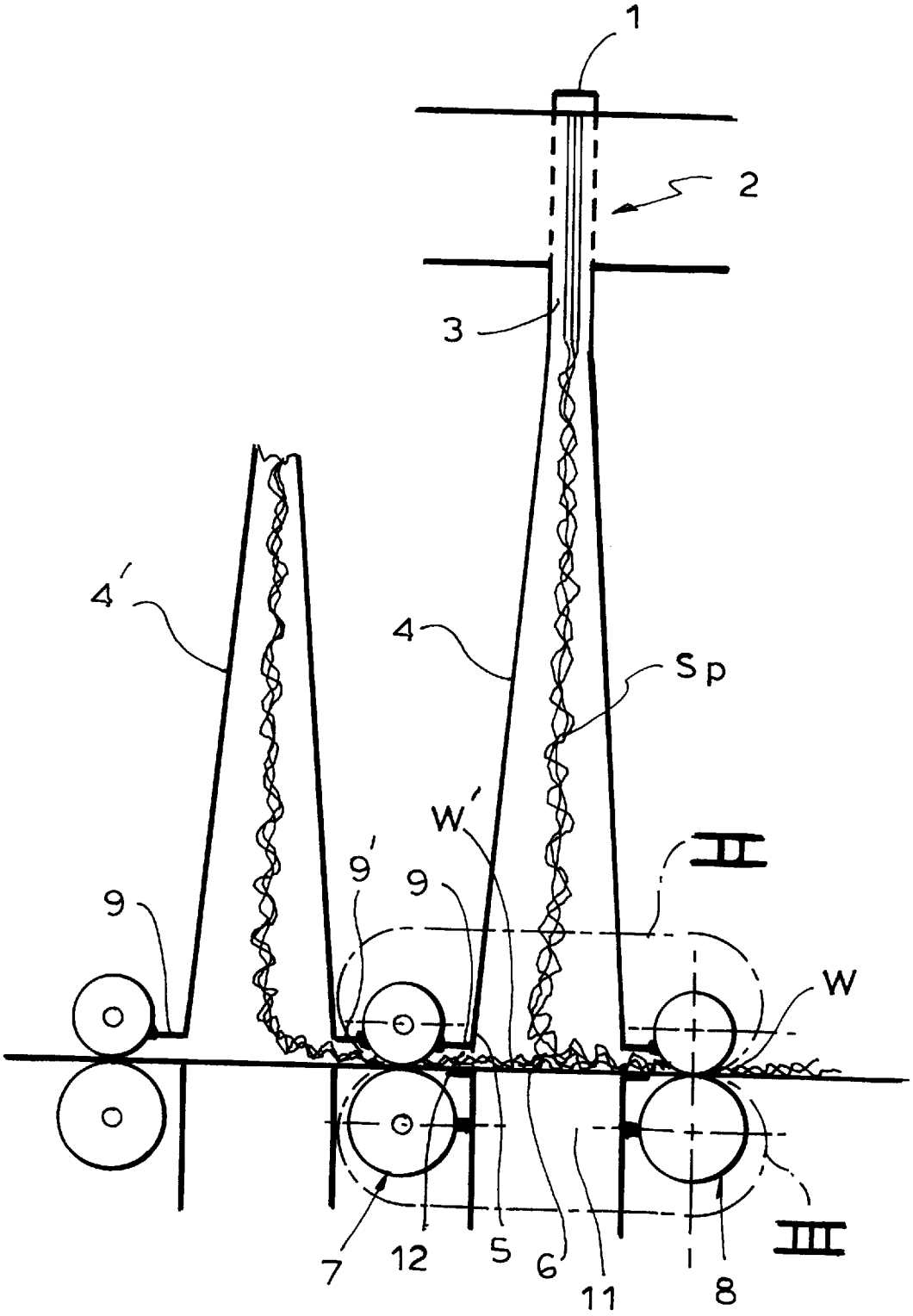
FIG. 5 is a view similar to FIG. 1 but illustrating another embodiment.

In FIG. 5 we have shown a second diffuser 4' with its partitions 9' upstream of the device of FIG. 1 so that a further web W' is formed and the surface W and W' can be layered. Otherwise the principles described above apply here as well.

We claim:

1. An apparatus for producing a spun-bond web from synthetic-resin filaments, comprising:

a spinneret for producing a descending curtain of synthetic-resin filaments;

means forming a cooling zone traversed by said curtain of synthetic-resin filaments below said spinneret for contacting said filaments with cooling air;

a stretching shaft below said cooling zone for stretching said filaments by entrainment of said filaments in process air passing through said stretching shaft;

downwardly diverging walls below said stretching shaft forming a diffuser traversed by said curtain of filaments and inducing intermingling of said filaments;

an endless sieve surface spaced below a bottom of said diffuser for collecting intermingled filaments from said diffuser in a web and displacing said web in a direction from beneath said diffuser;

a suction shaft below said surface and said bottom of said diffuser provided with means for drawing said process air from said diffuser through said surface and facilitating collection of the intermingled filaments upon said surface;

a pair of pressing rollers spaced downstream from said diffuser in said direction and including an upper pressing roller bearing upon said web;

a partition extending parallel to said surface from said bottom of said diffuser to said upper roller and defining a compartment with said surface extending from said bottom of said diffuser to said upper roller traversed by said web;

another partition extending parallel to said surface from said bottom of said diffuser to said upper roller of said downstream pair of pressing rollers; and respective seals between each of said partitions and the respective upper roller of the respective pair.

2. The apparatus defined in claim 1 wherein said partition is a closed wall of sheet metal or plastic.

3. The apparatus defined in claim 1 wherein said partitions are spaced from said surface by a distance of 15 to 50 mm.

4. The apparatus defined in claim 3 wherein said distance is about 20 mm.

5. The apparatus defined in claim 1 wherein said diffuser has movable walls to which said partitions are connected and said partitions are subdivided into two wall partitions, one of which is connected to a respective movable wall of said diffuser and another of which sealingly engages the respective upper roller, said wall portions of the respective partition overlapping one another.

6. The apparatus defined in claim 1 wherein said diffuser has respective walls at which said partitions are attached thereto and which are formed toward said surface as flow baffles for air passing from said diffuser into said chamber.

7. The apparatus defined in claim 1 wherein each of said partitions is a perforated plate through which air can be sucked into said chamber.

8. The apparatus defined in claim 7, further comprising means for controlling air flow through said perforated plates.

9. The apparatus defined in claim 1 wherein said partitions are perforated and located so that process air is sucked out of said chamber.

10. The apparatus defined in claim 9, further comprising means for controlling air flow through said partitions.

11. The apparatus defined in claim 1 wherein said suction shaft is formed at least on one side with a perforated wall in a region of a lower roller of one of said pairs of rollers extending transversely to said direction through which air entering the suction shaft can be sucked out.

12. The apparatus defined in claim 11, further comprising means for controlling air flow through said perforated wall.

* * * * *